United States Patent [19]

Ellison

[11] Patent Number: 4,638,282

[45] Date of Patent: Jan. 20, 1987

[54] WIRE CROSS-OVER ARRANGEMENT FOR COIL ASSEMBLY

[75] Inventor: Donald E. Ellison, St. Clair Shores, Mich.

[73] Assignee: United Technologies Automotive, Inc., Dearborn, Mich.

[21] Appl. No.: 756,463

[22] Filed: Jul. 18, 1985

[51] Int. Cl.[4] ..... H01F 27/30

[52] U.S. Cl. ..... 336/185; 336/192; 336/198

[58] Field of Search ..... 310/194; 242/118.41, 242/118, 117; 336/198, 208, 192, 185

[56] References Cited

U.S. PATENT DOCUMENTS

| | | | |
|---|---|---|---|
| 2,298,357 | 10/1942 | Elvin et al. | 336/208 X |
| 2,355,477 | 8/1944 | Stahl | 336/198 X |
| 3,457,534 | 7/1969 | Davis | 336/198 X |
| 3,573,694 | 4/1971 | Von Fange | 336/198 |
| 3,661,342 | 5/1972 | Sears | 336/208 X |
| 4,151,500 | 4/1979 | Malerba et al. | 336/185 |
| 4,183,002 | 1/1980 | Haslau | 336/198 X |
| 4,195,278 | 3/1980 | Doyle et al. | 336/192 X |
| 4,353,051 | 10/1982 | Wille et al. | 336/208 X |

FOREIGN PATENT DOCUMENTS

| | | | |
|---|---|---|---|
| 2754221 | 6/1979 | Fed. Rep. of Germany | 336/208 |
| 2326769 | 4/1977 | France | 336/198 |
| 36973 | 3/1980 | Japan | 242/118.41 |

*Primary Examiner*—Thomas J. Kozma

*Attorney, Agent, or Firm*—Stephen A. Schneeberger

[57] ABSTRACT

A coil assembly, as for the secondary of a high voltage ignition transformer, includes a coil subdivided into segments by radial flanges on a coil bobbin. Cross-over grooves provided in the bobbin flanges allow the coil wire transitioning from one coil segment or slot into the next to be relatively isolated from contact with coil-turns of greatly different electrical potential. The formation of the cross-over groove in a respective bobbin flange is such that the cross-over of the coil wire from one segment to the next is forced to occur and remain at a radially-outward position relative to the formed coils. Guide ridges facilitate the cross-over of the coil wire at the entry to a respective cross-over groove.

6 Claims, 5 Drawing Figures

FIG. 1
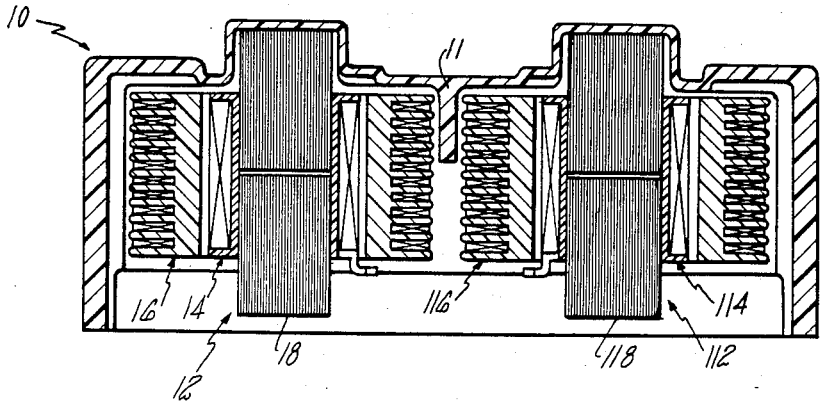
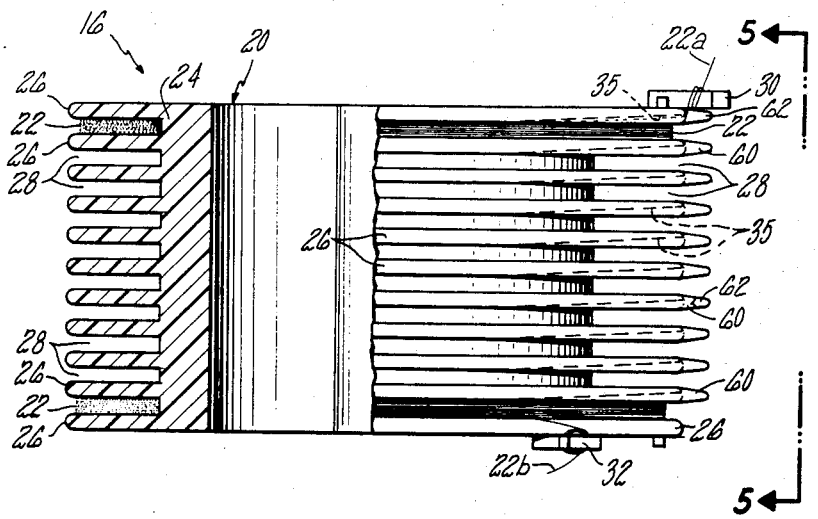
FIG. 2

WIRE CROSS-OVER ARRANGEMENT FOR COIL ASSEMBLY

TECHNICAL FIELD

The invention relates generally to a coil assembly, such as a transformer coil assembly, and more particularly to a multiple slot bobbin used in such coil assemblies, particularly for high voltage applications.

BACKGROUND ART

Electrical coil assemblies exist for numerous applications. In one application, that of voltage step-up or step-down, an induced voltage of one potential in a primary coil is stepped-up or stepped-down by a secondary coil as a function of the turns ratio. High voltage transformers of relatively small size exist both in communications equipment, such as televisions and the like, and in ignition systems for automobiles and the like. In each instance a relatively low potential applied to a primary coil is stepped-up to a relatively high voltage, i.e. thousands of volts, by a secondary winding.

In the design of such high-voltage coil assemblies as exist in the secondary of an automotive ignition transformer, it is necessary to design against electrical shorting or arcing in order to ensure the long life and integrity of the coil. Because each coil-turn in the secondary develops a potential thereacross and because such high voltage secondaries may include a very large number of turns, and thus a large total potential across the entire coil, care must be taken to minimize electrical shorting between coil-turns. Normally, the wire used in winding a coil will include a thin, insulative coating which may be rated for several hundred volts. In the winding of such a coil, it is necessary that a coil-turn of a relatively low potential not be in contact with a coil-turn of a substantially higher potential. To this end, the bobbin structure for the secondaries of high voltage transformers have been provided with multiple slots which effectively provide numerous small coils of limited axial extent. Examples of such coil assemblies are depicted in U.S. Pat. No. 4,274,136 to Onodera et al; U.S. Pat. No. 4,388,568 to Goseberg et al and PCT Application No. DE83-00184 of Worz having International Publication No. WO84/02224.

By employing the winding configuration of the aforementioned patents, and assuming for example that each coil-turn develops a potential thereacross of five volts and that ten such coil-turns exist in a particular layer in each slot on the bobbin, then each adjacent coil-turn in a particular layer in a slot will differ by only five volts from that of the preceding or following coil-turn and the coil-turns in the layer immediately above or below will typically differ in potential by only about 50 volts.

While the provision of slots in the bobbin does provide a plurality of coils of limited axial extent and thus limited difference in the potential between successive layers of coil-turns within a slot, there remains the possible problem that the coil wire which normally transitions or crosses-over from the uppermost layer of coil-turns in one slot to the lowermost layer of coil-turns in the next adjacent slot will be placed in undesirable proximity or contact with some of the radially uppermost or outermost turns in the second slot which have a greatly different electrical potential. Moreover, even in situations in which the difference in electrical potential is far less, the insulating coating on the coil wire which crosses over from one slot to the next may be subjected to considerable abrasion by the coil windings as they are subsequently formed. The aforementioned U.S. Pat. No. 4,274,136 discloses the use of notches or recesses in the flanges which constitute the walls to the successive slots. These recesses extend axially the full way through a respective flange and radially from the outer surface of the bobbin spindle to the radially outer end of the flange. While the provision of such recesses does enable the coil wire to transition from one slot to the next, it does not appear to provide particularly good separation or isolation of the transitioning coil wire from either the outermost coil-turns in the slot into which it is transitioning or the inward coil-turns in the slot from which it is originating. In this latter regard, when the coil-turns are completed in one slot and the transition is made from that slot to the bobbin spindle in the next adjacent slot via the notched recesses of U.S. Pat. No. 4,274,136, there exists the possibility that the winding tension on the wire will cause the transitioning wire to be pulled radially downward between the coil and the flange of the slot from which it is transitioning. In such instance, it will be appreciated that the aforementioned problem is again created, however, in this instance in a reversed manner.

DISCLOSURE OF INVENTION

Accordingly it is a principal object of the invention to provide a coil assembly, particularly though not exclusively for high voltage applications, which minimizes the possibility of electrical shorting or breakdown between coil-turns. It is a further object of the invention to provide an improved coil assembly of the type employing a multiple-slot bobbin.

According to the invention, there is provided an improved coil assembly of the type which includes a bobbin and a multi-turn winding of coil wire disposed on the bobbin. The bobbin includes a central spindle and a plurality of axially-spaced annular flanges extending radially outward from the spindle to define a plurality of respective slots between the axially-inner surfaces of adjacent pairs of the flanges. The coil winding is disposed in multiple layers in the respective slots on the bobbin and is continuous between the successive slots in which it is disposed.

The improvement specifically includes providing a cross-over groove formed in the axially-inner surface of one flange of each pair of flanges between which a winding is disposed for receiving the coil wire which transitions from one slot to an other. The cross-over groove extends from a position near the radially-outer edge of the respective flange in an inward direction substantially tangent to the bobbin spindle. The width and depth of the groove in the respective flange is such that, at least toward the radially-outer end of the flange, the full diameter of the coil wire is received therein while it also preserves the separating function of the flange. By allowing the diameter of the wire to be fully received within the groove, its contact with the various layers of the coil winding in the slot into which it is transitioning is minimized or eliminated. Moreover, by preserving the separating function of the flange, as by preventing the groove from extending axially all the way through the flange, the wire is also prevented from being forced radially inward in the slot from which it is transitioning.

The cross-over groove extends to a position of substantial tangential coincidence with the bobbin spindle and its axial depth in the wall of the flange gradually decreases in a direction toward the bobbin spindle; however, the groove depth is preferably always greater than the diameter of the coil wire. To ensure that the coil wire remains in the groove during a "worst-case" winding operation, the depth of the groove at the radially outer end of the flange is substantially as great as the axial width of the respective slot. The transition of the coil wire from one slot into the groove of the next slot is guided by a pair of radially-outwardly extending ridges at the radially-outward end of a respective flange and disposed on angularly opposite sides of the cross-over groove.

BRIEF DESCRIPTION OF THE DRAWINGS

FIG. 1 is a sectional view of a pair of twin high voltage ignition transformers, each employing a transformer secondary coil assembly in accordance with the invention;

FIG. 2 is a side view, partly in section, of a partly wound secondary coil assembly of FIG. 1;

BEST MODE FOR CARRYING OUT THE INVENTION

Figure 3:
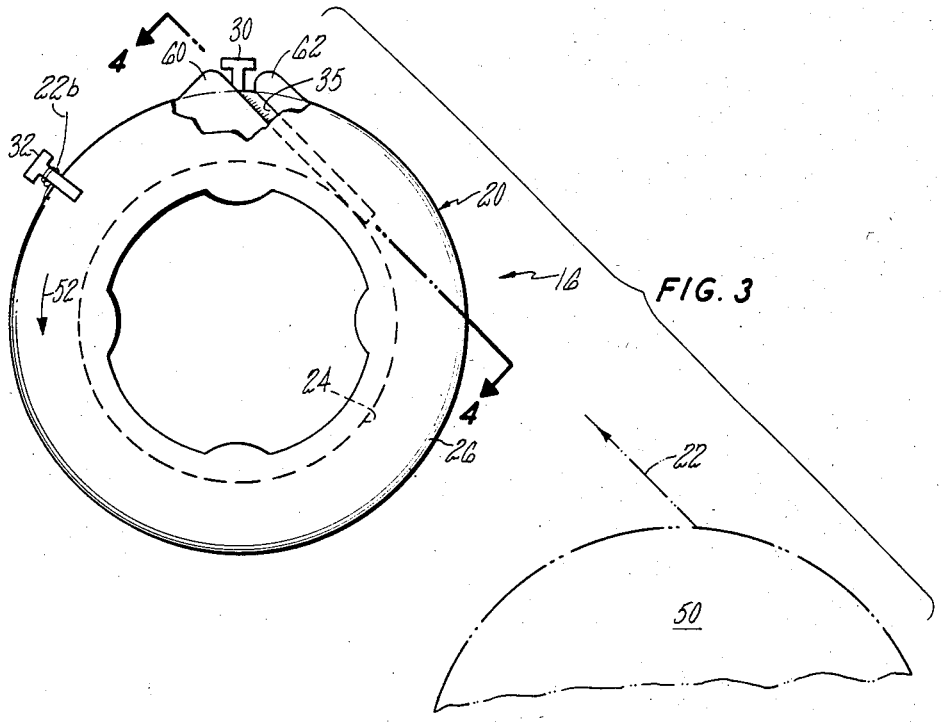
FIG. 3 is an end view of the secondary coil assembly of FIG. 2.

Referring to FIG. 1, there is illustrated an automotive ignition unit 10 comprised of twin, high voltage ignition transformers 12 and 112 contained within a molded plastic housing 11. Each transformer 12, 112 includes a respective primary assembly 14, 114, a respective secondary assemblies 16, 116 and a respective lamination assembly 18, 118. The secondary assemblies 16, 116 are concentrically disposed about the respective primary assemblies 14, 114. The lamination assemblies 18, 118 aid in magnetically interconnecting the respective primary and secondary assemblies 14, 16 and 114, 116 in a known manner. In the illustrated embodiment, the primary and secondary windings may have a ratio of about 1:100 such that an induced voltage of about 400 volts in a primary coil will result in a 40,000 volt potential across the terminals of the respective secondary coil assembly.

For the purposes of describing the present invention, only the secondary coil assembly 16 will be described in detail. To obtain the 40,000 volt output from the secondary coil assembly 16, the secondary 16 will be required to have approximately 10,000 coil-turns. Accordingly, referring additionally to FIGS. 2 and 3, the coil assembly 16 includes a bobbin 20 of insulating material on which is formed a 10,000-turn winding of insulated coil wire 22. The bobbin 20 is formed of a suitable rigid plastic and includes an annular spindle portion 24 having a radially-outer surface on which the coil wire 22 is wound.

Because of the relatively high electrical potential associated with the coil assembly 16, the bobbin 20 is axially segmented by the provision of a series of annular, axially-shaped flanges 26 which are integral with and extend radially outward from the bobbin spindle 24 to form respective slots 28 therebetween. In the illustrated embodiment, the bobbin 20 is provided with ten equally-sized slots 28 defined by eleven flanges 26. Approximately 1,000 turns of coil wire 22 are disposed in each of the ten slots 28 to provide a total of 10,000 turns. The coil wire 22, including its insulating coating, may typically have a diameter of about 0.002 inch and the width $W_S$ of a respective slot 28 may typically be about 0.050 inch such that approximately 25 coil-turns may be wound in a single layer of common radius within a particular slot. Thus, there may be approximately 40 layers of such windings within a respective slot 28. Each coil-turn may represent an associated difference in electrical potential of approximately four volts, with a particular layer within a slot 28 representing a difference in electrical potential of approximately 100 volts. Obviously then, the difference in electrical potentials between radially inner and outer layers of windings of wire 22 in a particular slot 28 may be approximately 4,000 volts.

Each bobbin 20 is provided with a pair of tie-off tees 30 and 32, disposed at opposite ends of the coil assembly 16. With reference to the sequence with which the coil wire 22 is wound on the bobbin 20, the tie-off tee 30 seen uppermost in FIG. 2 represents the beginning or start of the winding of wire 22 and the tie-off tee 32 represents the end. Thus, the end **22*a* of coil wire 22 is tied to tie-off tee 30 to begin the coil winding process and the end 22*b* is finally tied to the tie-off tee 32** to complete that process.

In accordance with the invention, a cross-over groove 35 is formed in the interior wall of one of each pair of flanges 26 which define a respective slot 28. More specifically, a cross-over groove 35 is formed in the interior wall of each flange 26 that is followed by a respective slot 28, starting with the end of bobbin 20 at which the first coil segment is wound, as represented by the tie-off tee 30. Each cross-over groove 35 facilitates the transition of the coil wire from the top of a completed winding in a preceding slot 28 into the next adjacent slot 28 and more specifically, to the spindle 24 of bobbin 20 to begin the winding process in that slot.

Importantly, a cross-over groove 35 is structured so as to facilitate the avoidance of contact of the transitioning coil wire 22 entering a slot 28 to begin a winding on spindle 24 with the later-completed coil-turns of the winding. This minimizes or eliminates abrasion of the insulating coating on the transitioning coil wire 22 and thus is desirable even for coil assemblies of relatively lower voltage ranges. Moreover, for a high voltage coil assembly it minimizes the possibility of breakdown or arcing in the region of the coil turns which are positioned relatively toward the radially-outward end of the slot. The groove 35 has a depth $D_G$ (seen in FIG. 4) in the axial direction into a flange 26 and a corresponding width $W_G$ transverse thereto. Both the depth $D_G$ and the width $W_G$ of the groove 35 are sufficient to receive the full diameter of the coil wire 22 (0.002 inch) therewithin over its length. The cross-over groove 35 extends from a position at the radially outer edge of a flange 26 in a direction which is substantially tangential to the outer surface of the bobbin spindle 24. The groove 35 extends at least to a point of tangency with the bobbin spindle 24 and typically, a small distance beyond.

Figure 4:
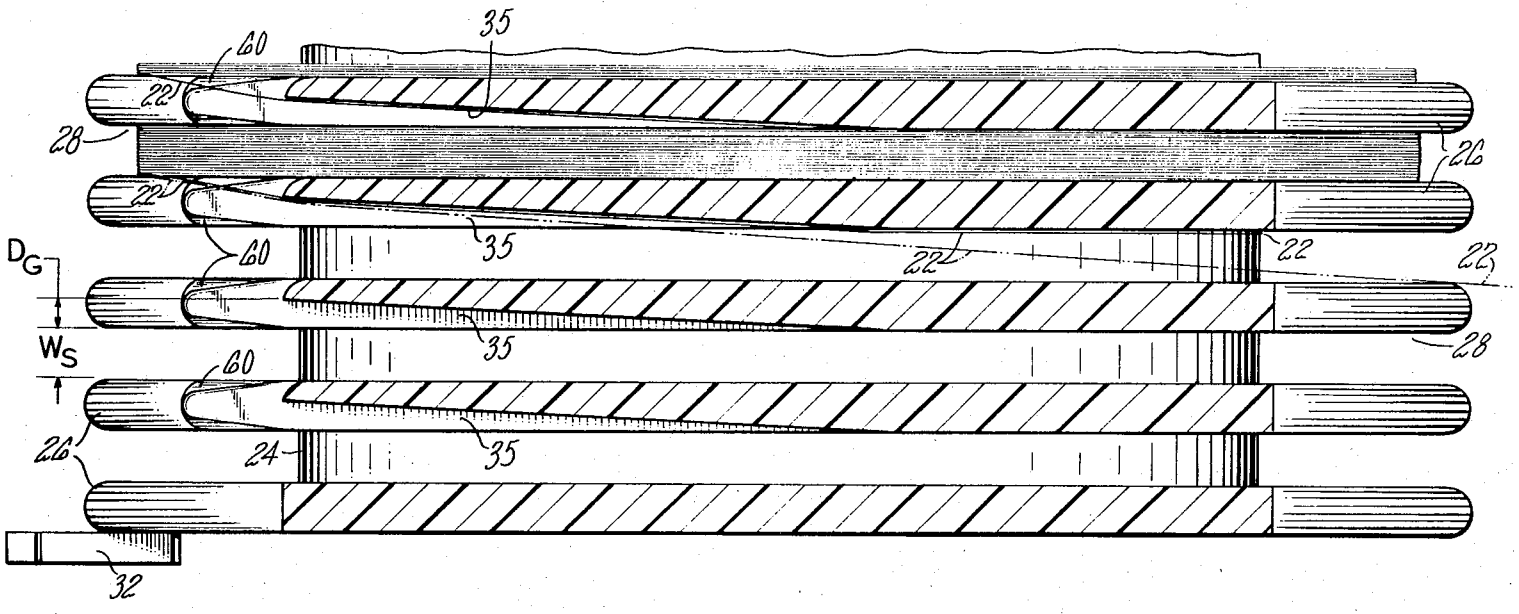
FIG. 4 is an enlarged sectional view of the coil assembly of FIG. 3, taken along line 4—4 thereof, to illustrate the cross-over grooves of the invention.

As a further feature of the invention, the radially-outermost or "entering" end of cross-over groove 35 has a depth $D_G$ which has approximately a 1:1 correlation with the width $W_S$ of a corresponding slot 28, such that the coil wire 22 lies within the groove 35 over its full length even if the lead of the wire from a supply spool is in contact with the interior face of the opposite flange 26 as depicted in broken line in FIG. 4. Such situation might be characterized as a "worst case" winding condition and the objects of the invention are met by providing such adequate depth to the "entering" end of the cross-over groove 35.

Although the cross-over groove 35 might have a uniform depth $D_G$ throughout its length, it will be advantageous to gradually decrease that depth substantially to zero in the direction toward the point of tangency with the bobbin spindle 24. Such arrangement allows continued support of the coil wire 22 by the base of the cross-over groove 35 throughout its length and further ensures the structural integrity of the respective flange 26 in which it is formed. It will be noted that although the groove 35 has a substantial depth $D_G$ at its "entering" end, it nonetheless preserves the integrity of the respective flange 26. Importantly also, the base or root of each cross-over groove 35 is sufficiently continuous along its length that the coil wire 22 transitioning from a preceding slot 28 to a following slot 28 may not be drawn radially inward along the side of the winding in the preceding coil.

Figure 5:
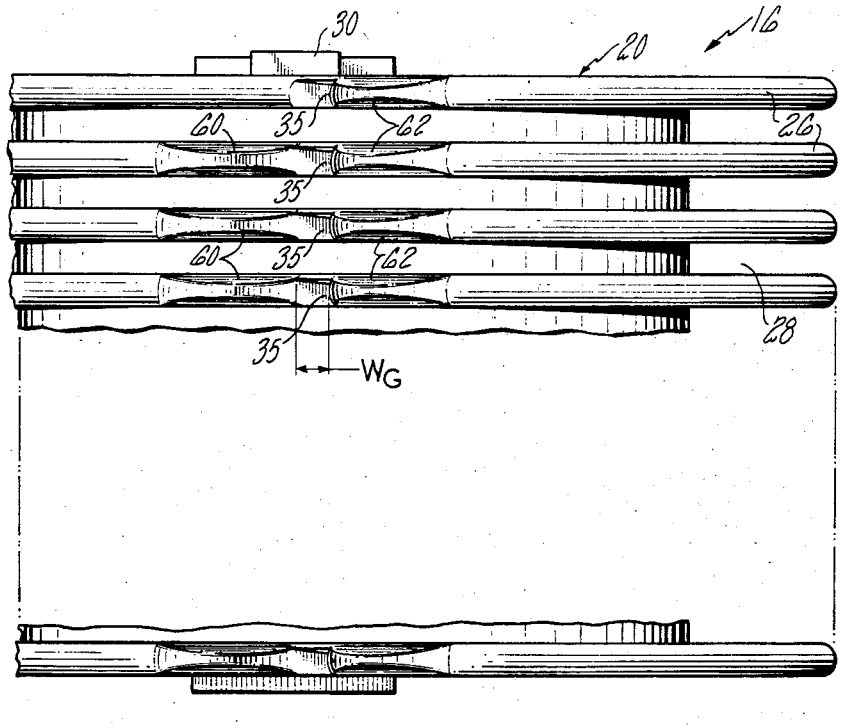
FIG. 5 is an enlarged, partly broken away, view of the coil assembly of FIG. 2 taken along lines 5—5 therein.

As represented in FIG. 3, a supply spool 50 of coil wire 22 is represented in broken line for supplying coil wire for the winding of the coil assembly 16. The bobbin 20 is rotated in the direction indicated by the arrow 52 depicted thereon and begins at the far end represented by tie-off tee 30 and proceeds toward the near end represented by tie-off tee 32. Viewing FIGS. 4 and 5, the winding of bobbin 20 proceeds from left to right such that as shown therein, when a winding is completed in one slot 28 the coil wire 22 is led, via a cross-over groove 35 to the next adjacent slot therebelow. To further facilitate the transitioning of coil wire 22 from one slot to the next during the winding operation, pairs of lobes or guide ridges 60 and 62 are positioned adjacent the entry to cross-over groove 35 on angularly-opposite sides thereof. The guide ridges 60, 62 are smoothly-contoured lobes which extend radially outward from a respective flange 26 and aid in guiding the coil wire 22 into a respective cross-over groove 35.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. In a coil assembly including a bobbin and a multi-turn winding of coil wire disposed on the bobbin, the bobbin including a central spindle and a plurality of axially-spaced annular flanges extending from the spindle to define a plurality of respective slots between the axially-inner surfaces of adjacent pairs of said flanges and the winding being disposed in multiple layers in the respective said slots on the bobbin and being continuous between successive said slots in which it is disposed, the improvement wherein:

one flange of each pair of said flanges between which the winding is disposed including a cross-over groove formed in the axially inner surface thereof for receiving the coil wire which transitions from one said slot to another, said cross-over groove extending from a position near the radially-outer edge of the respective said flange in an inward direction substantially tangent to and to a position of substantial tangential coincidence with said bobbin spindle, the width and depth of said groove in the respective said flange being such as to receive the full diameter of the coil wire therewithin throughout the extent of said groove while also preserving the separating function of the flange, thereby to minimize or prevent contact of the coil wire transitioning into a slot with the radially outward windings in the respective slot and with the radially inward windings in the slot from which it is transitioning, and wherein the axial thickness of a said flange is greater than the axial width of a said slot, the diameter of the coil wire is many times less than said axial width of a respective said slot, said cross-over groove is directly axially open to said slot, and the depth of a said cross-over groove for a respective said slot at least near its outer end relative to the bobbin spindle is substantially as great as the axial width of the respective said slot such that the coil wire necessarily lies within said groove for substantially the full length of said groove.

2. The coil assembly of claim 1 wherein the depth of each said cross-over groove decreases in the direction toward the bobbin spindle.

3. The coil assembly of claim 1, said coil assembly being the secondary of a high voltage transformer, and wherein the number of said multiple layers of turns of said core wire is such that the difference in electrical potential between a winding at the base of a slot adjacent to the bobbin spindle and a winding toward the radially outermost extreme of the windings in the respective said slot is at least several thousand volts and the coil wire transitioning into a respective slot is at substantially the potential of a said winding at the base of the respective said slot.

4. The coil assembly of claim 1 wherein each said flange which separates one said slot from another includes means at a radially outer end and adjacent to a respective said groove therein for guiding the coil wire in its transition out one slot and into the cross-over groove in the next slot.

5. The coil assembly of claim 4 wherein said coil wire guiding means includes at least one radially-outwardly extending ridge at the radially outer end of a respective said flange.

6. The coil assembly of claim 5 wherein said coil wire guiding means includes a pair of radially-outwardly extending ridges at the radially outward end of a respective said flange and disposed on angularly opposite sides of the cross-over groove.

* * * * *